US006199802B1

(12) United States Patent
Scheibe, Sr.

(10) Patent No.: US 6,199,802 B1
(45) Date of Patent: Mar. 13, 2001

(54) COLLAPSIBLE TRASH BAG HOLDER

(76) Inventor: Gary C. Scheibe, Sr., 2161 Titan St., Harvey, LA (US) 70058

( * ) Notice: Subject to any disclaimer, the term of this patent is extended or adjusted under 35 U.S.C. 154(b) by 0 days.

(21) Appl. No.: 09/252,116

(22) Filed: Feb. 18, 1999

(51) Int. Cl.[7] ..... A63B 55/04
(52) U.S. Cl. ..... 248/97; 248/99; 248/101
(58) Field of Search ..... 248/97, 95, 99, 248/101, 150, 151, 163.1, 166, 172, 173, 439; 403/205, 403, 295, 174; 285/133.4, 133.11, 133.21, 133.3, 133.5, 133.6

(56) References Cited

U.S. PATENT DOCUMENTS

| | | | | |
|---|---|---|---|---|
| 1,838,180 | * | 12/1931 | Hitchcock | 285/332.1 |
| 2,257,427 | * | 9/1941 | Parker | 285/133.4 |
| 2,751,237 | * | 6/1956 | Conley | 285/133.4 |
| 4,157,801 | * | 6/1979 | Elmer | 248/97 |
| 4,488,697 | * | 12/1984 | Garvey | 248/101 |
| 4,562,983 | * | 1/1986 | Klefbeck | 248/97 |
| 4,889,300 | * | 12/1989 | Gibson et al. | 248/97 |
| 4,899,967 | * | 2/1990 | Johnson | 248/97 |
| 4,901,959 | * | 2/1990 | Stage | 248/97 |
| 5,060,893 | * | 10/1991 | Halbert | 248/97 |
| 5,150,980 | * | 9/1992 | Lin | 403/24 |
| 5,183,226 | * | 2/1993 | Brooks | 248/97 |
| 5,393,023 | * | 2/1995 | Callan | 248/97 |
| 5,564,660 | * | 10/1996 | Gyor | 248/97 |
| 5,738,314 | * | 4/1998 | Davis | 248/97 |
| 5,772,256 | * | 6/1998 | Martin | 285/61 |
| 5,797,567 | * | 8/1998 | Magnafici | 248/97 |

* cited by examiner

*Primary Examiner*—Ramon O. Ramirez
*Assistant Examiner*—Tan Le

(57) ABSTRACT

A collapsible trash bag holder for holding a trash bag open. The collapsible trash bag holder includes a ring portion comprising a plurality of arcuate ring sections. The ring portion is adapted for receiving a trash bag through it. A plurality of generally T-shaped T-fittings couple the ring sections together. A plurality of legs are pivotally coupled to the T-fittings and downwardly extend therefrom for supporting the ring portion in a spaced apart relationship from a ground surface.

1 Claim, 2 Drawing Sheets

COLLAPSIBLE TRASH BAG HOLDER

BACKGROUND OF THE INVENTION

1. Field of the Invention

The present invention relates to garbage bag holders and more particularly pertains to a new collapsible trash bag holder for holding a trash bag open.

2. Description of the Prior Art

The use of garbage bag holders is known in the prior art. More specifically, garbage bag holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,174,085; U.S. Pat. No. 4,307,861; U.S. Pat. No. 3,771,752; U.S. Pat. No. 4,783,031; U.S. Pat. No. 2,470,977; and U.S. Pat. No. Des. 216,438.

While these devices fulfill their respective, particular objectives and requirements, the aforementioned patents do not disclose a new collapsible trash bag holder. The inventive device includes a ring portion comprising a plurality of arcuate ring sections. The ring portion is adapted for receiving a trash bag through it. A plurality of generally T-shaped T-fittings couple the ring sections together. A plurality of legs are pivotally coupled to the T-fittings and downwardly extend therefrom for supporting the ring portion in a spaced apart relationship from a ground surface.

In these respects, the collapsible trash bag holder according to the present invention substantially departs from the conventional concepts and designs of the prior art, and in so doing provides an apparatus primarily developed for the purpose of holding a trash bag open.

SUMMARY OF THE INVENTION

In view of the foregoing disadvantages inherent in the known types of garbage bag holders now present in the prior art, the present invention provides a new collapsible trash bag holder construction wherein the same can be utilized for holding a trash bag open.

The general purpose of the present invention, which will be described subsequently in greater detail, is to provide a new collapsible trash bag holder apparatus and method which has many of the advantages of the garbage bag holders mentioned heretofore and many novel features that result in a new collapsible trash bag holder which is not anticipated, rendered obvious, suggested, or even implied by any of the prior art garbage bag holders, either alone or in any combination thereof.

To attain this, the present invention generally comprises a ring portion comprising a plurality of arcuate ring sections. The ring portion is adapted for receiving a trash bag through it. A plurality of generally T-shaped T-fittings couple the ring sections together. A plurality of legs are pivotally coupled to the T-fittings and downwardly extend therefrom for supporting the ring portion in a spaced apart relationship from a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible trash bag holder apparatus and method which has many of the advantages of the garbage bag holders mentioned heretofore and many novel features that result in a new collapsible trash bag holder which is not anticipated, rendered obvious, suggested, or even implied by any of the prior art garbage bag holders, either alone or in any combination thereof.

It is another object of the present invention to provide a new collapsible trash bag holder which may be easily and efficiently manufactured and marketed.

It is a further object of the present invention to provide a new collapsible trash bag holder which is of a durable and reliable construction.

An even further object of the present invention is to provide a new collapsible trash bag holder which is susceptible of a low cost of manufacture with regard to both materials and labor, and which accordingly is then susceptible of low prices of sale to the consuming public, thereby making such collapsible trash bag holder economically available to the buying public.

Still yet another object of the present invention is to provide a new collapsible trash bag holder which provides in the apparatuses and methods of the prior art some of the advantages thereof, while simultaneously overcoming some of the disadvantages normally associated therewith.

Still another object of the present invention is to provide a new collapsible trash bag holder for holding a trash bag open.

Yet another object of the present invention is to provide a new collapsible trash bag holder which includes a ring portion comprising a plurality of arcuate ring sections. The ring portion is adapted for receiving a trash bag through it. A plurality of generally T-shaped T-fittings couple the ring sections together. A plurality of legs are pivotally coupled to the T-fittings and downwardly extend therefrom for supporting the ring portion in a spaced apart relationship from a ground surface.

Still yet another object of the present invention is to provide a new collapsible trash bag holder that is height adjustable.

Even still another object of the present invention is to provide a new collapsible trash bag holder with legs that angle out to permit a trash bag to be filled to its full capacity. This is often not possible with garbage cans, since the bag is limited to the inner diameter of the garbage can. Thus, the wasting of large, half empty plastic bags is eliminated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
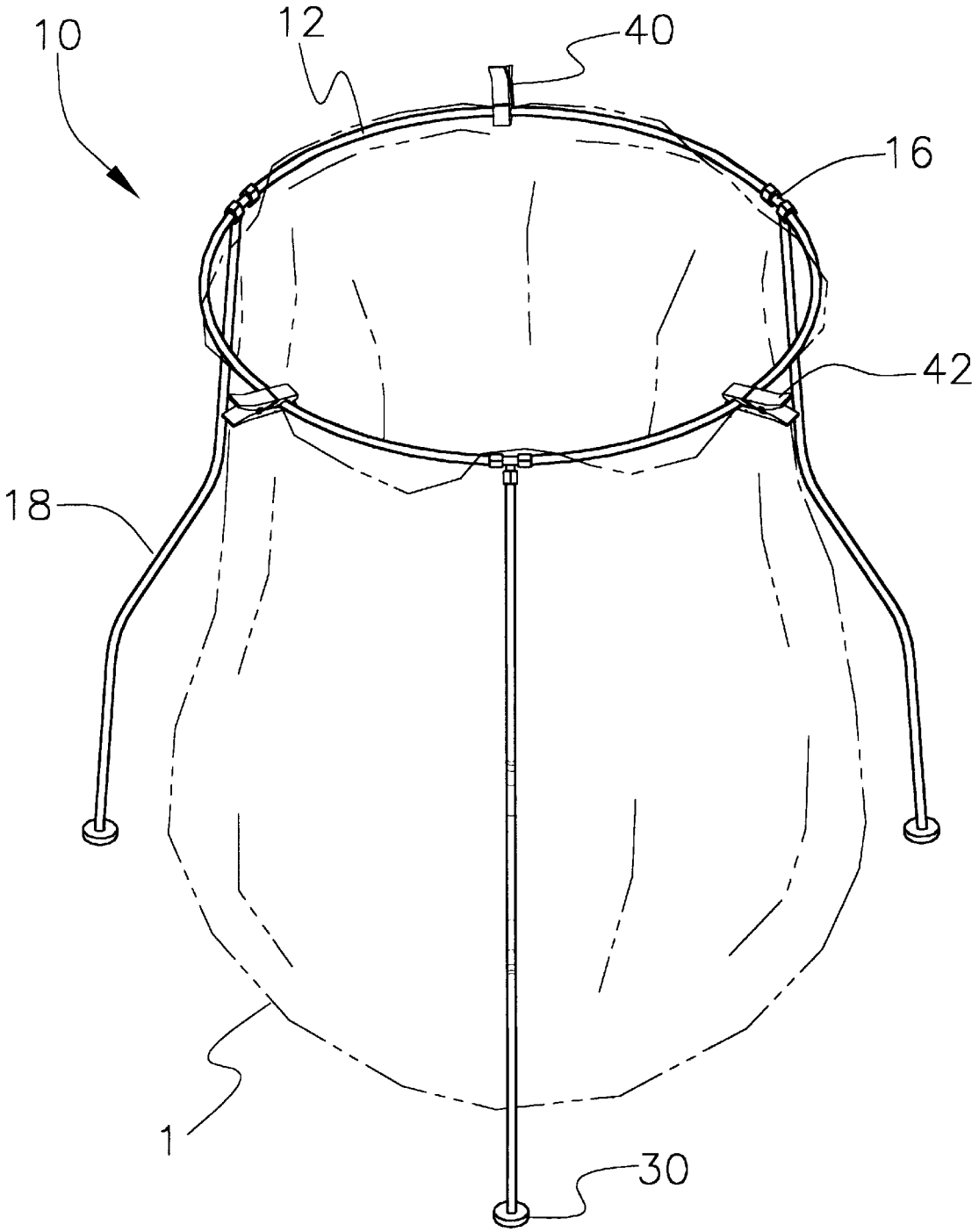
FIG. 1 is a schematic perspective view of a new collapsible trash bag holder according to the present invention.
Figure 2:
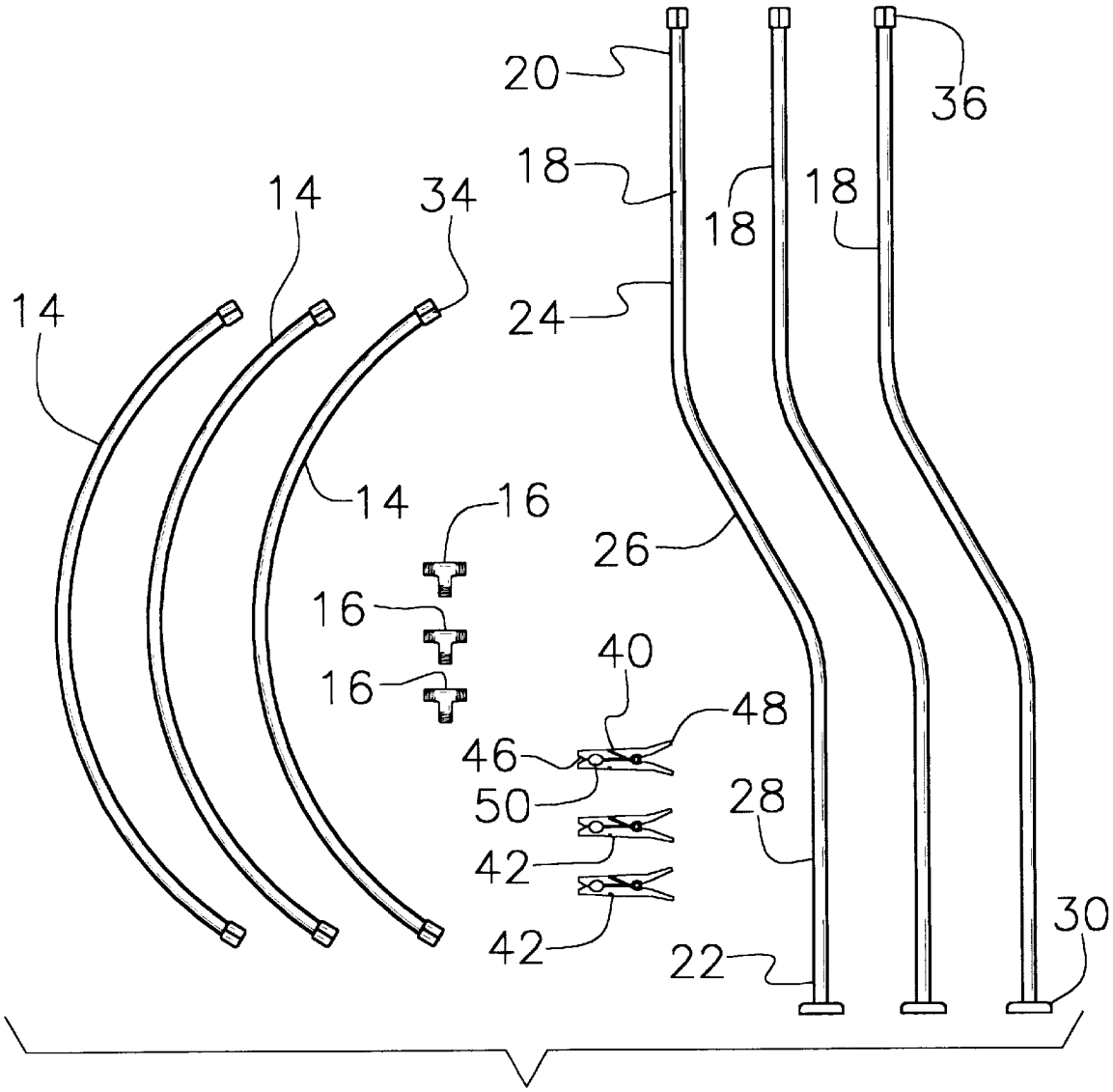
FIG. 2 is a schematic side view of the various parts of the present invention.
Figure 3:
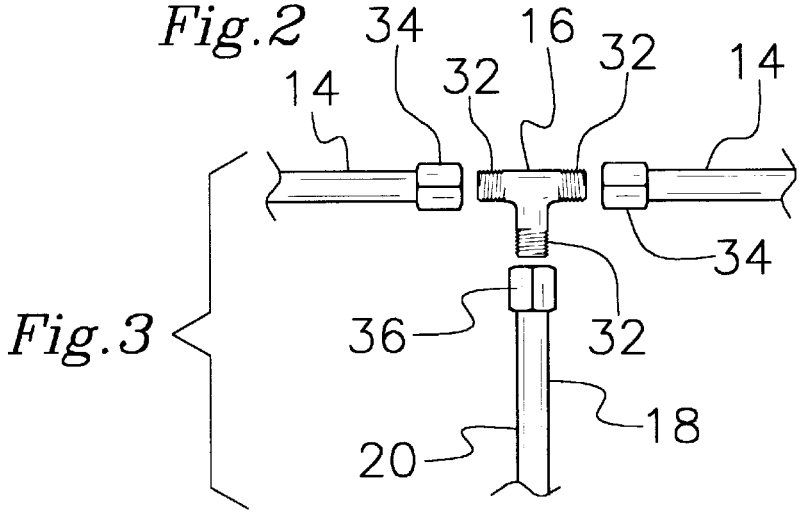
FIG. 3 is a schematic detailed exploded view of a T coupling of the present invention.

With reference now to the drawings, and in particular to FIGS. 1 through 3 thereof, a new collapsible trash bag holder embodying the principles and concepts of the present invention and generally designated by the reference numeral 10 will be described.

As best illustrated in FIGS. 1 through 3, the collapsible trash bag holder 10 generally comprises a ring portion 12 comprising a plurality of arcuate ring sections 14. The ring portion is adapted for receiving a trash bag 1 through it. A plurality of generally T-shaped T-fittings 16 couple the ring sections together. A plurality of legs 18 are pivotally coupled to the T-fittings and downwardly extend therefrom for supporting the ring portion in a spaced apart relationship from a ground surface. Three legs and three ring sections has been found to provide sufficient support while utilizing the least amount of parts. This configuration is also easier to quickly assemble and disassemble.

Preferably, each of the legs has top and bottom ends 20,22, and upper, middle, and lower portions 24,26,28. The upper portions are positioned towards the top ends of the legs. In such an embodiment, each of the middle portions is angled from the associated upper portion at an obtuse angle preferably of between about 20 and 90 degrees. Each of the lower portions is angled from the associated middle portion at an obtuse angle preferably of between about 20 and 90 degrees such that the lower portions lie on a line extending parallel the associated upper portions. The exemplary angles between the upper and middle portions and middle and lower portions shown in the Figures are both about 28 degrees.

Each of the legs is pivotable between a deployed position and a retracted position. The lower portions of the legs are positioned outwardly of the ring portions when the legs are in the deployed position. The lower portions of the legs are positioned inwardly of the ring portions when the legs are in the retracted position.

The legs are placed in the deployed position to provide maximum stability, but equally importantly, to permit full use of the bag. As the bag fills, the sides of the bag expand. When placed in a garbage can, the sides of the bag are limited to the inner diameter of the garbage can, which are often straight. The angled legs of the present invention permit the bag to spread out to its maximum size. The legs may be placed in the retracted position for storage, or where the ground surface space is limited. The legs may be placed midway between the retracted and deployed positions such that they lie nearly directly underneath the ring portion to save space when using.

Preferably, each of the bottom ends of the legs has a base disc 30 coupled to it to help prevent the legs from sinking into a ground surface when a load is placed on the bag holder.

Also preferably, the T-fittings are pivotable with respect to (i.e., about) the ring portion to permit pivoting of the legs towards and away from the ring portion for permitting adjustment of a height of the ring portion above the ground surface. If the legs are positioned substantially vertically, the highest height is achieved. However, when a user is kneeling down, such as to pull weeds, a lower positioning of the ring portion is desirable. To lower the ring portion, the legs are placed in the deployed position and pivoted away from the ring portion and each other until the ring portion is at the desired height. The pivoting function is also useful for storage, the legs may be positioned in the retracted position, then the legs pivoted inwardly to join the bottom ends of the legs together.

In the preferred embodiment, each of the T-fittings has threaded ends 32. Ideally, free ends of each of the ring sections of the ring portion each have nuts 34 rotatably coupled to them. The nuts of the ring sections are threadedly coupled to the T-fittings. Also ideally, the top end of each of the legs has a nut 36 rotatably coupled thereto. The nuts of the legs are threadedly coupled to the T-fittings. The rotating nuts permit easy disassembly for storage and transport without having to turn the entire part to unscrew it. The nuts are simply rotated with respect to the associated part to detach them from the T-fittings.

Another unique feature of this arrangement is that though the legs are able to pivot together and apart about the ring portion, the curvature of the ring sections does not permit them to significantly pivot with respect to each other (i.e., they stay substantially on a plane extending across the ring portion).

A length of each of the legs is defined between its ends. The preferred length of each of the legs is between about 20 and 28 inches, ideally about 24 inches for standard size lawn and garden bags. The legs would be between about 10 and 16 inches for smaller bags, such as grocery bags.

The preferred inner diameter of the ring portion is between about 16 and 20 inches, ideally about 18 inches. This range of dimensions has been found to provide the most compatibility with standard sizes of garbage bags, while providing an opening large enough for easy insertion of debris. The inner diameter of the ring portion would be between about 8 and 14 inches for smaller bags, such as grocery bags.

Optionally, a plurality of clipping means 40 may be provided for clipping an upper rim of the trash bag to the ring portion. Preferably, the clipping means comprise clips 42 each having a pair of opposed finger portions 44. Each of the finger portions has a first and a second end 46,48. The first ends of a pair of the finger portions are biased together.

The first end of each finger portion has an inner channel 50 extending perpendicular to a longitudinal axis of the finger portion. The inner channels of the finger portions of each clip face each other. The inner channel has a radius of curvature about equal to the radius of curvature of an outer periphery of the ring portion.

The second ends of the finger portions of each clip flare outwardly to increase the distance that the first ends of the finger portions may be opened. This also permits the second ends to be shortened, which is important since a shorter clip is less likely to catch on refuse is thrown in the bag.

In use, the legs are placed in the desired position and a bag is placed through the ring portion. The upper rim of the bag is clipped to the ring portion with the clips. Debris is placed in the bag. When the bag is full, the clips are removed and the bag holder is lifted off of the bag, or the bag is pulled out of the holder between the legs, so that the bag may be disposed of.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A bag holder, comprising:

a ring portion comprising a plurality of arcuate ring sections, said ring portion being adapted for receiving a bag therethrough;

a plurality of generally T-shaped T-fittings coupling said ring sections together;

a plurality of legs being pivotally coupled to said T-fittings and downwardly extending therefrom for supporting said ring portion in a spaced apart relationship from a ground surface;

each of said legs having top and bottom ends, and upper, middle, and lower portions;

said upper portions being positioned towards said top ends of said legs, each of said middle portions being angled from the associated upper portion at an obtuse angle between about 20 and 90 degrees, each of said lower portions being angled from the associated middle portion at an obtuse angle between about 20 and 90 degrees such that said lower portions lie on a line extending parallel the associated upper portions;

each of said legs being pivotable between a deployed position and a retracted position, said lower portions of said legs being positioned outwardly of said ring portions when said legs are in said deployed position, said lower portions of said legs being positioned inwardly of said ring portions when said legs are in said retracted position;

each of said bottom ends of said legs having a base disc coupled thereto for helping prevent said legs from sinking into a ground surface;

said T-fittings being pivotable with respect to said ring portion for permitting pivoting of said legs towards and away from said ring portion for permitting adjustment of a height of said ring portion above said ground surface;

each of said T-fittings having threaded ends, free ends of each of said ring sections of said ring portion having a nut rotatably coupled thereto, said nuts of said ring sections being threadedly coupled to said T-fittings;

said top end of each of said legs having a nut rotatably coupled thereto, said nuts of said legs being threadedly coupled to said T-fittings;

a length of each of said legs being defined between said ends thereof;

wherein an inner diameter of said ring portion is between about 16 and 20 inches;

a plurality of clipping means for clipping an upper rim of said bag to said ring portion;

wherein said clipping means comprise clips each having a pair of opposed finger portions, each of said finger portions having a first and a second end, said first ends of a pair of said finger portions being biased together;

said first end of each of said finger portions having an inner channel extending perpendicular to a longitudinal axis of said finger portion, said inner channels of said finger portions of each clip facing each other, said inner channel having a radius of curvature about equal to the radius of curvature of an outer periphery of said ring portion; and said second ends of said finger portions of each clip flaring outwardly for increasing the distance that said first ends of said finger portions may be opened.

* * * * *